United States Patent [19]

Peterson

[11] Patent Number: 4,905,945

[45] Date of Patent: Mar. 6, 1990

[54] REFUSE CAN STABILIZING APPARATUS AND METHOD AND APPARATUS FOR MANUFACTURE

[76] Inventor: Daryl Peterson, 1002 Chenowith, North Bonneville, Wash. 98639

[21] Appl. No.: 128,813

[22] Filed: Dec. 4, 1987

[51] Int. Cl.[4] ..... A47G 23/02

[52] U.S. Cl. ..... 248/146; 220/1 T; 220/69; 248/346; 248/907; 248/910

[58] Field of Search ..... 248/907, 910, 679, 146, 248/346, 346.1, 154; 220/1 T, 69; 215/100.5

[56] References Cited

U.S. PATENT DOCUMENTS

| | | | |
|---|---|---|---|
| 2,260,570 | 10/1941 | John | 248/DIG. 7 X |
| 2,545,320 | 3/1951 | Tilson et al. | 248/DIG. 7 X |
| 2,555,455 | 6/1951 | Platt . | |
| 2,626,078 | 1/1953 | Hutchisson, Jr. et al. | 248/DIG. 7 X |
| 2,650,786 | 9/1953 | Platt | 248/DIG. 7 X |
| 2,683,579 | 7/1954 | Wallace . | |
| 2,841,351 | 7/1958 | Riepen | 248/DIG. 7 X |
| 3,137,469 | 6/1964 | Stanley | 248/DIG. 7 X |
| 3,201,075 | 9/1965 | Sievers . | |
| 3,224,595 | 12/1965 | Sherley | 248/DIG. 7 X |
| 3,272,466 | 9/1966 | Sherman | 248/DIG. 7 X |
| 3,310,266 | 3/1967 | Larkin et al. . | |
| 3,471,114 | 10/1969 | Ball . | |
| 4,609,901 | 9/1986 | Hamm | 248/679 X |

FOREIGN PATENT DOCUMENTS

| | | | |
|---|---|---|---|
| 595176 | 3/1960 | Canada | 248/146 |
| 1304703 | 8/1962 | France | 220/69 |

*Primary Examiner*—David L. Talbott
*Attorney, Agent, or Firm*—Kolisch, Hartwell & Dickinson

[57] ABSTRACT

A unitary, molded, concrete stabilizing base for refuse cans and the like, and method and apparatus for its manufacture are described. The base takes the form of a concrete annulus having a right-triangular cross section and an inner diameter dimensioned freely to receive a frusto-conical refuse can having a base diameter within a range of predetermined diameters. The inner cylindrical surface and the outer frusto-conical surface of the toroid smoothly are joined in a substantially rounded way. In use, and in the presence of lateral forces incident upon the installed refuse can, e.g. crosswinds, the base and the can cooperate by the impingement of their inner and outer surfaces to resist the tendency of the refuse can to tip and spill its contents. In a modification, the effective height of the base is increased by stacking the base atop a concrete annular platform of substantially equal diameters, thereby increasing further the range of refuse can base diameters that securely can be accommodated. Method and apparatus for manufacture of the base involve flexing an inverted, unitary, fiberglass mold convexly downwardly to strip the base therefrom under the influence of gravity. By the preferred method of flexing and stripping, an outer annular region of the mold is heated while an inner central region of the mold is cooled to produce a temperature gradient in the mold.

5 Claims, 2 Drawing Sheets

REFUSE CAN STABILIZING APPARATUS AND METHOD AND APPARATUS FOR MANUFACTURE

BACKGROUND AND SUMMARY OF THE INVENTION

The present invention relates to apparatus for stabilizing refuse cans or the like, and method and apparatus for their manufacture. More specifically, a molded concrete base is described, which provides for the vertical stabilization of industrial sized refuse cans, such as those used in parks, against lateral winds and inadvertent spillage. Method and apparatus for the manufacture of such a base also are described, in which a unitary single-cavity, fiberglass mold is flexed to facilitate the stripping of the concrete base therefrom.

Known waste receptacle bases either elaborately are secured to the receptacles, thereby frustrating routine maintenance, or they relatively easily are maintained, but also easily are damaged or dislocated by crosswinds, wildlife or vandals. Illustrative of the former is the base described in U.S. Pat. No. 2,650,786, wherein a stepped, formed concrete structure supports a garbage can and a bolt-mounted, steel frame having a can hold-down assembly. Illustrative of the latter is the base described in U.S. Pat. No. 3,471,114, wherein a ballast-filled, molded, annular base structure grippingly supports a garbage can.

The base described in U.S. Pat. No. 2,650,786 is, in its modified form, a permanent, molded, square, concrete base having a generally cylindrical aperture and an annular, garbage can supporting shoulder. On its rectilinear perimeter, a stepped ledge is equipped with opposite, vertically extending standards which form a heavy steel framework including a handle portion and a horizontal brace that pivotally mounts a garbage can cover hold-down assembly The hold-down assembly permits the lifting of the cover, and also acts to retain the cover in its closed position and the can in its proper upright position. Such modification from a portable hand truck-like device to a permanent garbage can holder requires the substitution of the concrete base for a base plate assembly; the removal of wheels and axle; and the removal of a size adjustable, can gripping band assembly, the last of which is described, in the context of portable can holders, as preventing horizontal and vertical movement of the can relative to the base plate and accommodating conventionally manufactured garbage cans of various diameters and heights.

The base described in U.S. Pat. No. 3,471,114 is size-specific and tapered precisely to conform to the outer surface of the lower portion of a customized garbage container. The lower portion of the container has a bottom that is flanged to provide a horizontal, annular shoulder, which rests on the upper edge of the base to elevate the garbage container above the ground. A bottom wall of the base has an annular recess, located midway between the inner and outer edges, and a threaded passageway that communicates with the base's hollow interior. A threaded plug may be installed and removed from the threaded passageway for filling and emptying the base with ballast, e.g. water or sand. The base is molded of a conformable, presumably polymeric material, which is susceptible of wear, tear, vandalism and spillage of ballast. Because the inner surface of the base is sized and tapered "snugly" to conform to the container, installation and removal of the garbage container requires precise placement and alignment, and even slightly undersized or misshapen containers will not be secured properly to prevent their inadvertent dislocation and potential spillage.

It has been decades since there have been any significant advances in refuse can stabilizing apparatus. Heretofore, it was thought that a compromise was necessary between the seemingly inconsistent goals of security against spillage and facility of use. Even the most advanced prior art apparatus, such as that described by Pratt in U.S. Pat. No. 3,471,114, would require periodic refilling, or topping, of the hollow base with ballast, as the ballast evaporates (water) or settles (sand), and the base described therein provides for the secure stabilization of only those garbage containers having one specific shape and size. It is desirable instead to provide a secure, durable and easy to use stabilizing base for refuse cans and the like, the design of which accommodates the inevitably variant diameters and shapes of the bottoms of conventionally manufactured waste containers of the same, nominal capacity.

A principle object of the invention is to provide a base for a refuse can that vertically stabilizes the can against lateral forces, such as crosswinds, that would upset the can and spill its contents.

Another important object to the invention is to provide a base that, while secure, does not obstruct normal use or normal maintenance, including installation and removal, of the refuse can.

A further, important object of the invention is to provide a base that accommodates refuse cans that vary somewhat in shape or diameter, or that are misshapen by normal use.

Yet another object of the invention is to provide a base that is inexpensive to manufacture, requires little or no maintenance and lasts a long time.

Finally, it is an object of the present invention to provide method and apparatus for manufacturing such a stabilizing base.

In the preferred embodiment of the invention, the stabilizing base takes the form of a unitary, molded, fiber mesh-reinforced concrete annulus dimensioned to extend circumferentially, but loosely, around the bottom portion of a refuse can extending therethrough, and resting therewith on a base supporting surface, e.g. the ground. An inner, substantially right-cylindrical surface of the annulus is dimensioned freely to receive therein a refuse can the bottom portion of which has a diameter within a predefined range of diameters. The base substantially is rounded at the upper vertex of the right triangle, thereby to permit a refuse can easily to be installed therein and removed therefrom and, under the influence of lateral forces such as crosswinds, to rock slightly therealong and better to distribute the load bearing upon the base. The base is sufficiently heavy to provide substantial resistance to crosswinds, and yet is sufficiently light to render the base manually portable. Although the base is of a height that is an insubstantial fraction of the height of the refuse can, it is capable of withstanding substantial crosswinds or other lateral forces, such as a nudge or sideswipe by a foraging animal. The concrete admixture may be color tinted to permit the base either to blend, or to contrast, with its environment.

In a modification to the preferred embodiment, the range of refuse can diameters that securely may be accommodated by the stabilizing base is extended downwardly by increasing the effective height of the base. This increase is effected by providing a right-cylindrical, annular platform on which the base of the preferred embodiment may be stacked. With the combination of the stabilizing base and one or more stackable, elevating platforms, refuse cans manufactured to different nominal dimensions or refuse cans that, with use, have become out-of-round or otherwise misshapen may be accommodated, while maintaining a consistency in the appearance of bases in a variety of applications and settings.

In the preferred method of manufacturing the refuse can stabilizing base of the preferred embodiment, a unitary, single-cavity, fiberglass mold is provided with a generally planar, radially extending, flanged portion on its outer periphery. The mold first is prepared for casting by depositing a release agent along the interior surface that will come into contact with the concrete admixture, and then pouring the concrete admixture into the mold's cavity. What will become the lower outside edge of the base is beveled, e.g. by use of a trowel, to "knock off" what would otherwise be a sharp, annular edge, and the concrete is allowed to moisture-cure to a high strength of approximately 3500 pounds per square inch (PSI). When the mold containing the cured base is inverted onto a flange engaging annular strut, or stand-off, of greater inside diameter (ID) than the outside diameter (OD) of the base, the base is stripped from the mold of its own weight. Optionally, the stripping of the base from the mold is facilitated by the application of heat to the outer, annular region of the mold, by the extraction of heat from the inner central region of the mold, or both, thereby flexing the inverted mold convexly downwardly. Such flexing overcomes surface tension between the mating surfaces of the base and the mold along the right-cylindrical inner and frusto-conical outer annular regions.

In use, a refuse can easily may be installed in, or removed from, the base, as the refuse can freely fits within the base. In the presence of crosswinds, or other lateral forces, incident upon the outer surface of the refuse can, the can is permitted to tilt slightly, causing a portion of its bottom lip and a elliptically opposed portion of its lower, outer surface to impinge upon, and thus lock within, the inner annular surface of the base. Because the refuse can rests on the ground, rather than upon an annular shoulder or circular platform as in prior art apparatus, the stabilizing base of the present invention does not permit the accumulation of foreign material between the can and the base providing, in effect, a self-cleaning feature. The density and strength of the fiber mesh-reinforced concrete used to form the stabilizing base and the upper, broadly rounded 'edge' of the base minimize, to negligible effect, abrasion between the can and the base, thereby greatly extending the life of both. Finally, the concrete material from which the base is made is virtually impervious to environmental elements or mischief. The straightforward method and apparatus for manufacture, wherein a reusable, flexible, shape-retentive fiberglass mold is used to produce a base easily stripped therefrom, greatly reduce the nonrecurring expense, as well as the unit cost, of manufacture.

These and other objects and advantages of the present invention more clearly will be understood from a consideration of the drawings and the following description of the preferred embodiment.

DETAILED DESCRIPTION OF THE PREFERRED EMBODIMENT

Figure 1:
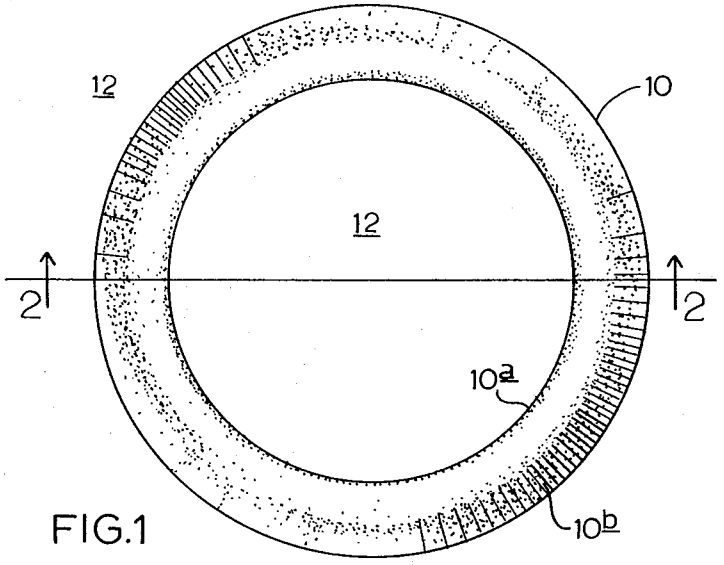
FIG. 1 shows, in top view, a refuse can stabilizing base manufactured in accordance with the preferred embodiment of the invention.
Figure 2:
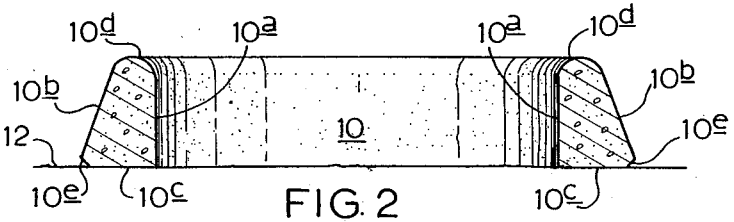
FIG. 2 is a cross-sectional, front elevation taken generally along the lines 2—2 of FIG. 1.

Referring collectively to FIGS. 1 and 2, a stabilizing base made in accordance with the preferred embodiment of the invention, and indicated generally at 10, straightforwardly is described. FIG. 1 shows a top view of base 10 resting upon a generally horizontal base supporting surface 12, e.g. the ground. In the preferred embodiment, base 10 takes the form of a circular, annular, or toroidal, expanse for extending circumferentially around a refuse can, base 10 having a substantially vertical annular inner surface 10*a* and an upwardly, inwardly tapering annular outer surface 10*b*. Base 10 is a unitary casting of fiber mesh-reinforced concrete, which optionally may be color-tinted, the composition and accelerated curing of which produces a structure of greater than 3500 PSI strength, in accordance with known commercial processes.

FIG. 2 shows, in a cross-sectional front elevation taken generally along the lines 2—2 of FIG. 1, the important cross-sectional features of base 10. As may be seen, substantially vertical inner surface 10*a*, which in the preferred embodiment tapers upwardly outwardly very slightly (1/16 inch), forms a substantially right-cylindrical space extending through base 10 from the top to the bottom, providing access therebeneath to base supporting surface 12. Importantly, where inner surface 10*a* and outer surface 10*b* join, they are smoothly rounded in what may be described as a circular arc 10*d* of substantial radius. This important aspect of the invention provides a number of advantages. First, the rounded upper 'edge' of base 10 facilitates entry therein of a refuse can or the like for placement on the base supporting surface 12. Second, as will be described in detail in reference to FIG. 3, rounded portion 10*d* provides a shoulder on which a refuse can or the like, under the influence of lateral forces, can roll, thereby minimizing abrasion of either the refuse can or the base. Third, broadly rounded portion 10*d* is believed optimally to distribute the lateral load bearing upon the upper inner surface of base 10 in the presence of lateral forces, effectively providing a region, rather than a point or a line, over which such forces are distributed.

A circular annular bottom surface 10c, which is shown in FIG. 2 resting on base supporting surface 12, closes the cross-sectional perimeter of substantially right-triangular, annular base 10. A beveled annular portion 10e extends between outer surface 10b and bottom surface 10c at approximately a 45° angle, thereby preventing the chipping away of an otherwise sharp edge, and increasing the safety with which base 10 may be handled.

Figure 3:
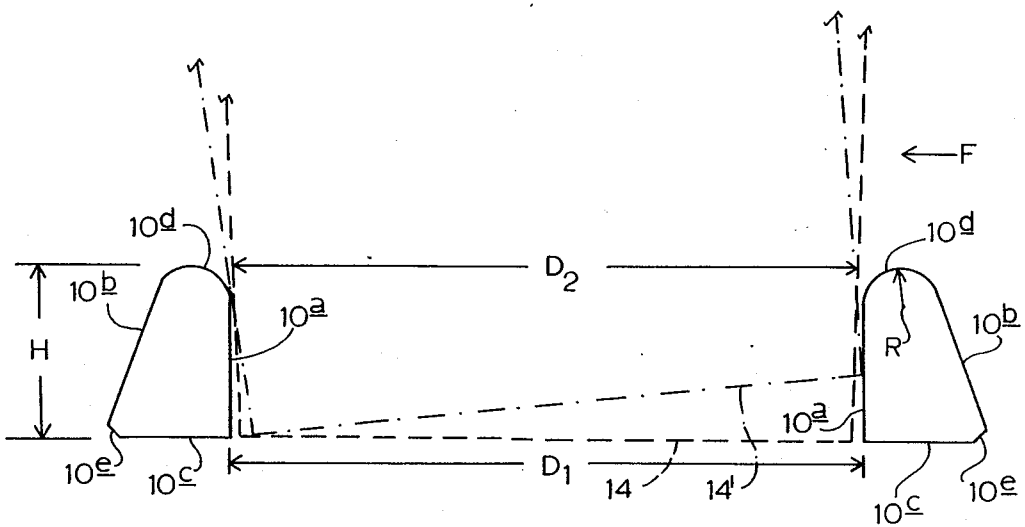
FIG. 3 shows, in schematic form, the detailed cross-sectional geometry of the preferred embodiment of the invention, as used with a refuse can and in the presence of a lateral force.

FIG. 3 is a schematic, cross section of base 10, corresponding generally to FIG. 2, and showing the general outline, by dashed line 14, of a refuse can installed therein. In order to appreciate the way in which base 10 and can 14 cooperate to resist substantial lateral forces, such as that shown at F, incident upon can 14, it is helpful first to understand the parameters of the problems sought to be solved by the present invention. Refuse cans typically vary somewhat in diameter, even when they are designed to the same capacity, e.g. 30 gallons, as manufacturing specifications and tolerances vary from one manufacturer to another and sometimes with the same manufacturer. Such variances make it difficult to design a stabilizing base that securely will accommodate most refuse cans. Conventional approaches to solving the problem require either a firm gripping of a customized can, or elaborate tie-down mechanisms for stabilizing the can and preventing its upset. Clearly, the former solution significantly increases the cost of the base and significantly decreases its versatility. The latter solution, because it requires tie-down means, suffers from a serious lack of facility in maintenance and use of the garbage can, because it renders difficult the installation, removal, relocation and use of the can. Providing only a partial solution, i.e. intentionally oversizing an annular portion of a base to accommodate a range of can diameters while not providing security against the upset of the can and spillage of its contents, is no solution at all.

The present invention solves this and other problems by permitting can 14 normally to rest on the ground beneath base 10. Base 10 is dimensioned freely to receive within the cylindrical space defined by annular inner surface 10a a refuse can having a base diameter within a substantial range of predetermined diameters. Stabilizing of can 14 within base 10 relies not on tie-down means, but rather on the cooperation between base 10 and can 14 under the influence of lateral forces. The stabilizing results achievable with the apparatus of the invention, in its preferred embodiment, are striking: the base and empty refuse can combination can withstand up to 70 mile per hour crosswinds, a not uncommon phenomenon in certain locales.

As illustrated in FIG. 3, under the presence of a sufficient lateral force F, can 14 will tend to be moved within base 10 to a tilted, or canted, position such as that shown by dash-dot outline 14'. Can 14 rolls along surface 10d only so far as permitted by the dimensional geometries relating the height H and the inside diameter D1 of base 10, and the outside diameter D2 of can 14. With the refuse can in the position indicated as 14', a bottom edge portion of can 14 engages inner surface 10a of base 10 and prevents further lateral movement, or tilting, of can 14. Thus, the invention relies on a cooperative, interference fit between base 10 and can 14 to prevent the can's upset. Can 14 will be securely captured, by impingement between outer annular regions of can 14 and inner annular regions of base 10, at least for the duration of the incidence of force F on can 14. Thereafter, can 14 typically will settle back into its position on the base supporting surface or, less frequently, will be wedged securely in a position such as 14' within base 10.

In the preferred embodiment of the invention, the height H of base 10 is approximately $5\frac{1}{4}$ inches and the inside diameter D1 is approximately $18\frac{5}{8}$ inches to accommodate a refuse can having a nominal 30 gallon capacity. These dimensions have been determined to accommodate refuse cans having a nominal outside diameter (near the bottom) D2 of between $17\frac{1}{2}$ inches and $18\frac{5}{8}$ inches, providing over a one inch range and tolerance sufficient to accommodate nearly all 30 gallon containers. It will be appreciated by those skilled in the art that, by appropriate changes to height H and inside diameter D1, a stabilizing base may be made, within the spirit of the invention, to accommodate refuse cans of different capacities.

In the preferred embodiment, annular bottom surface 10c is approximately 3 9/16 inches wide, thereby rendering the overall outside diameter of base 10 approximately $25\frac{3}{4}$ inches. The aspect ratio of the height to the width of the right-triangular cross section of base 10 may, or course, be varied, although it is believed that the substantially right-triangular shape cooperates with rounded upper 'edge' 10d advantageously to distribute the load borne along surface 10d when can 14 is under the influence of substantial lateral forces. In the preferred embodiment of the invention, the radius R of the rounded, upper 'edge' 10d of base 10 is approximately 1 inch. Thus, by providing a base having an inside diameter slightly greater than the outside diameter of the refuse can, installation and removal is extremely simple, and further is facilitated by the rounded 'edge' of the base at its upper extremity, through which can 14 is guided for placement on base supporting surface 12. Another important benefit accrues from the fact that base 10 is dimensioned freely to receive therein refuse can 14, has a generally vertical annular inner surface 10a and has no annular shoulder upon which refuse can 14 rests: debris such as dirt and gravel cannot accumulate in the base over time, as such instead will fall through the base and onto the ground during normal use and maintenance.

Figure 4:
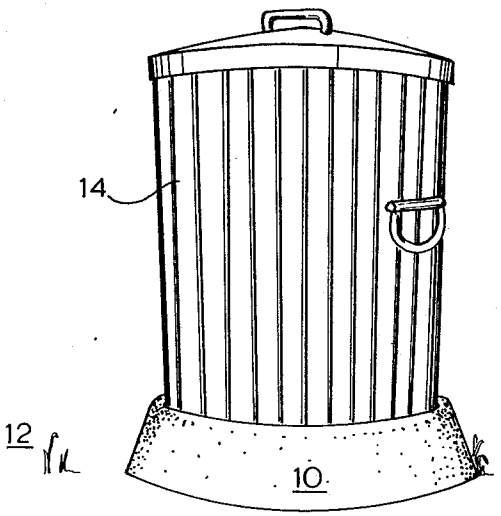
FIG. 4 shows, in perspective view, a stabilizing base made in accordance with the preferred embodiment, and used to stabilize a refuse can.

Turning briefly now to FIG. 4, base 10 is shown resting on base supporting surface 12 with refuse can 14 installed therein. The perspective view of FIG. 4 illustrates the aesthetic, as well as the functional, attributes of a stabilizing base made in accordance with the preferred embodiment of the invention. The height of the base, while an insubstantial fraction of the height of the container so as not to obstruct its use, nevertheless securely stabilizes the container against lateral forces, such as crosswinds or molestation by wild animals. The smoothly upwardly inwardly tapered frusto-conical outer surface and the rounded joinder between that surface and the inner annular surface provides a pleasing counterpoint to the oppositely tapered walls of the typical garbage can.

Figure 5:
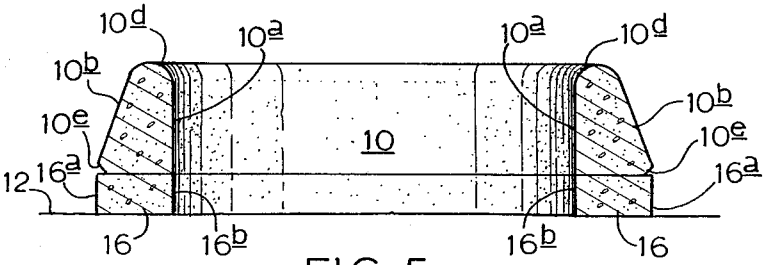
FIG. 5 shows a cross-sectional, front elevation corresponding to FIG. 2, except that it shows a modification to the preferred embodiment in which the stabilizing base is stacked atop an annular platform to increase its effective height.

Turning now to FIG. 5, which is a cross-sectional front projection corresponding generally with FIG. 2, a proposed modification to the preferred embodiment is shown. Means 16 for elevating base 10a predetermined distance above supporting surface 12, or means 16 for increasing the effective height of the stabilizing base takes the form of a right-cylindrical ring-like structure having a generally vertical outer surface 16a and a generally vertical inner surface 16b corresponding in diameter with the outside and inside diameters, respectively, of base 10. Ring-like structure 16, which clearly may take any of a variety of forms, is, in the preferred embodiment, approximately 2½ inches high and has a generally planar bottom for resting on supporting surface 12 and a generally planar top for supporting base 10. Increasing the height H (refer to FIG. 3) of base 10 increases the ratio between the height and the inside diameter of base 10, thereby extending downwardly the range of diameters of refuse cans that securely can be accommodated therein. While not normally required, as most containers may be securely accommodated by base 10 alone, structure 16 provides inexpensive means of elevating upper 'edge' 10*d* to a point higher on can 14, thereby to secure a can having a diameter as small as approximately 16½ inches. Clearly, multiple structures 16 may be stacked beneath base 10 to accommodate virtually any size of container, or of a container whose bottom edge is seriously misshapen by extensive wear or damage.

Turning finally to FIG. 6, method and apparatus for manufacture of base 10 are illustrated. Base 10 preferably is cast in concrete within a fiberglass mold, such as mold 18, which in the preferred embodiment is approximately ¼ inch thick (exaggerated, in the interest of clarity of illustration, in FIG. 6). An optionally tinted, fiber mesh-reinforced concrete admixture is poured into an annular recess and, while the admixture is still wet, base 10 is beveled at 10*e* (refer to FIGS. 2 and 3) in an appropriate manner, such as by use of a trowel or other masonry tool. The admixture then is wet-cured, in accordance with industry standard practice, to a desired strength, preferably greater than 3500 PSI. Mold 18 then is inverted for the stripping of base 10 therefrom.

Figure 6A:
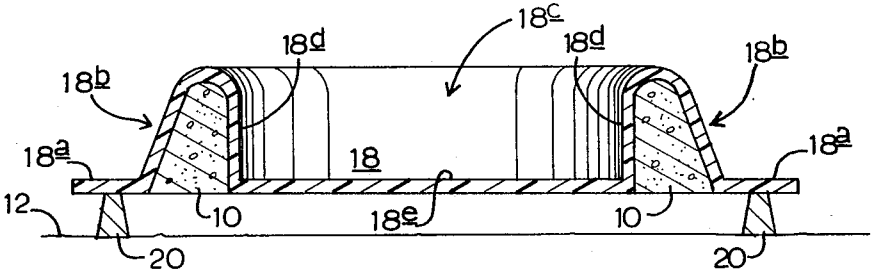
FIGS. 6*a*, 6*b* and 6*c* show, in a series of cross-sectional, front elevations corresponding to FIG. 2, three phases of the practice of the preferred method for manufacture of the stabilizing base, and the mold and strip apparatus used therein.

FIG. 6*a* shows the inverted mold 18 situated above base supporting surface 12 on standoffs 20, which may take the form of an annular ring of greater diameter than the outside diameter of base 10. Standoffs 20 exert a force, equal in magnitude to that of gravity, upwardly at various locations along the periphery of mold 18. Mold 18 includes a planar annular region 18*a* an outer, frusto-conical, annular region 18*b*, and an inner central region 18*c* including an inner annular region 18*d* and a circular planar region 18*e*. Radially extending flanged portion 18*a*, which lies generally in the plane defined by circular planar region 18*e*, provides for the gripping purchase of the mold containing base 10 and the inversion thereof. Base forming means are provided inwardly from flange portion 18*a*, and comprises mold sections, or walls, 18*b*, 18*d*, which are roundly joined at greatest depth of the annular recess, and 18*e*. Importantly, base forming means and annular region 18*a* are unitary, wherein flanged region 18*a* extends radially outwardly from base forming means by its joinder with outer wall 18*b* at its greatest radial extent, and comprise a structure that is flexible and shape retentive. In the preferred embodiment, mold 18 is made of fiberglass, although clearly a number of resins, for example, are available, with or without reinforcement, that will exhibit these important properties.

Figure 6B:
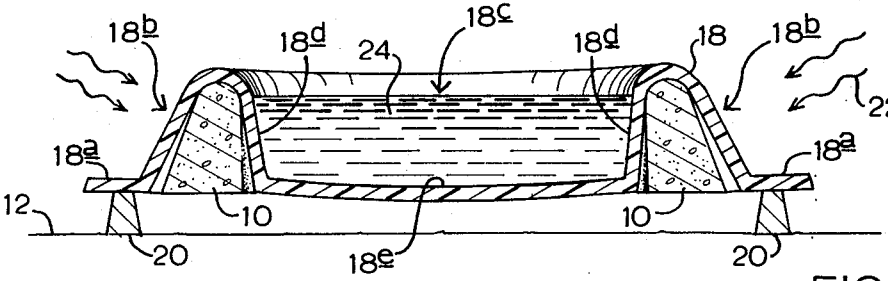

Turning now to FIG. 6*b*, a preferred method of stripping of base 10 from mold 18 is shown. As base 10 weighs approximately 60 pounds, there will be a tendency for mold 18 to flex convexly downwardly under the weight of base 10, between upwardly extending standoffs 20. As there is significant surface tension between the concrete mating surfaces of base 10 and the smooth surfaces of annular recess 18*e*, frequently base 10 will not strip itself from mold 18 my its own weight. A novel process step is proposed herein in which heat is applied, as shown by wavy arrows such as arrow 22, generally in the upper, outer annular region of mold 18, the effect of which is to cause the radial extremes of mold 18 to expand slightly. Alternatively, a process step is proposed in which a cooling liquid, e.g. water 24, is used to cool the inner, central region 18*c*, e.g. vertical annular region 18*d* and circular planar region 18*e*, effectively to cause a slight contraction of mold 18 along such cooled surfaces. Either the cooling or the heating, or their combination, effectively has been found to flex mold 18 convexly downwardly as shown in FIG. 6*b* in slightly exaggerated form, thereby overcoming the surface tension between base 10 and mold 18 especially along substantially vertical inner wall 18*d*.

Figure 6C:
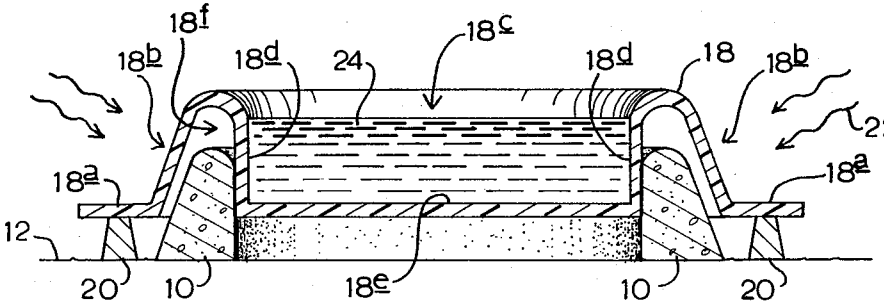

FIG. 6*c* shows the advantageous result of using a flexible, shape-retentive mold 18 and the self stripping technique disclosed herein. Base 10 is shown as having been released from mold 18 to rest on base supporting surface 12, without having to strip mold 18 from base 10. Essentially, the proposed method described herein of stripping base 10 from mold 18 may be thought of as the reverse of the more conventional process of stripping a mold from a casting. Mold 18 has returned to its unflexed condition in which flanged annular portion 18*a* and central circular portion 18*e* lie in a defined plane, and in which annular recess 18*f* is restored to its original shape. It will be appreciated by those skilled in the art that mold 18, made and used as illustrated and described in the manufacture of a base 10, is reusable. It also will be appreciated that, by providing appropriate reinforcement (such as fiberglass), abrasion of smooth, annular recess 18*f*, may be minimized and mold 18 may serve a long, useful life.

The objects of the invention thus are realized. An annular base forming a generally right-cylindrical through space may be used to vertically stabilize and thereby generally laterally to immobilize, refuse cans and the like, without elaborate tie-down means, at an extremely low level of maintenance and cost. The cross-sectional design and dimensioning of the base uniquely provide for the secure stabilization of refuse cans having a range of diameters, thereby significantly increasing the base's versatility. The concrete material from which the base is made provides sufficient density to enable the base to be kept small in dimension but large in stabilizing effect. By its inwardly upwardly tapering and substantially vertical outer and inner surfaces, respectively, which are smoothly and roundly joined at the height of the base, the stabilizing base of the present invention may be made as a unitary casting susceptible of inexpensive manufacture in a unitary mold. By the use of a flexible, shape-retentive mold the stabilizing base readily may be stripped from the mold without damage thereto, which stripping may be facilitated further by flexing the inverted mold convexly downwardly to overcome surface tension between mating surfaces of the concrete base and mold's sidewalls.

Accordingly, while a preferred embodiment of the invention and preferred method and apparatus for manufacture have been described herein, it is appreciated that further modifications are possible that come within the scope of the invention.

It is desired to claim by Letters Patent:

1. For vertically stabilizing a refuse can or the like on a generally horizontal supporting surface, the combination comprising:

a refuse can or the like having a nominal outside base diameter within a predetermined range of diameters, and a solid annular expanse having a substantially vertical annular first inner surface extending circumferentially around the lower portion of said refuse can or the like and being dimensioned such that said refuse can or the like freely is received within the space formed by said first inner surface without being supported by said expense and onto a generally horizontal supporting surface therebeneath and freely is removable therefrom, said first inner surface being dimensioned in height an insubstantial fraction of the height of said refuse can or the like and sufficient to offer substantial resistance to lateral forces incident upon said refuse can or the like by impingement, under the influence of such forces, between the outer surface of said refuse can or the like and said first inner surface.

2. For vertically stabilizing a refuse can or the like on a generally horizontal supporting surface, the combination comprising:

a refuse can or the like having a nominal outside base diameter within a predetermined range of diameters, and a solid annular expanse having an annular cross section defined by a circumscribing generally right triangle the right-angled sides of which form a generally horizontal bottom surface and a generally vertical annular first inner surface of said expanse, and the hypotenuse of which forms an upwardly inwardly extending outer surface, with said first inner surface and said outer surface joining in a smoothly rounded generally circular arc of substantial radius substantially below the apex of the triangle, said first inner surface forming within said expanse a generally right-cylindrical space extending smoothly and without interruption through said expanse and substantially from the top to the bottom thereof, said first inner surface extending circumferentially around the lower portion of said refuse can or the like and being dimensioned such that said refuse can or the like freely is received within the space formed by said first inner surface and freely is removable therefrom without being supported by said expanse, said first inner surface being dimensioned in height an insubstantial fraction of the height of said refuse can or the like and being of sufficient height to offer substantial resistance to lateral forces incident upon said refuse can or the like by impingement, under the influence of such forces, between the outer surface of said refuse can or the like and said first inner surface.

3. The combination of claims 1, or 2, further comprising means for elevating said expanse a predetermined distance above the supporting surface to increase the effective height of said expanse.

4. The combination of claim 3, wherein said elevating means includes a generally right-cylindrical ring-like structure having a generally planar bottom for resting on the supporting surface, a generally planar top for supporting said expanse, and a generally vertical second inner surface having an inside diameter generally equal to or greater than the diameter of said first surface.

5. The combination of claims 1, or 2, wherein said expanse is a unitary casting.

* * * * *